United States Patent [19]

Mott

[11] 4,071,088

[45] Jan. 31, 1978

[54] RETRIEVABLE SAFETY VALVE

[75] Inventor: James D. Mott, Houston, Tex.

[73] Assignee: Hydril Company

[21] Appl. No.: 614,989

[22] Filed: Sept. 19, 1975

Related U.S. Application Data

[60] Continuation of Ser. No. 542,603, Jan. 20, 1975, abandoned, which is a continuation of Ser. No. 363,532, May 24, 1973, abandoned, which is a division of Ser. No. 131,661, April 6, 1971, Pat. No. 3,763,933.

[51] Int. Cl.[2] ..... E21B 43/12

[52] U.S. Cl. ..... 166/321; 137/614.11; 251/62

[58] Field of Search ..... 166/314, 315, 72, 125, 166/126, 135, 224, 321, 322; 251/58, 62, 95; 137/458, 494, 614.11, 614.2

[56] References Cited

U.S. PATENT DOCUMENTS

| | | | |
|---|---|---|---|
| 2,998,077 | 8/1961 | Keithahn | 166/226 |
| 3,216,501 | 11/1965 | Page, Jr. | 166/72 |
| 3,236,255 | 2/1966 | Sizer | 137/494 |
| 3,292,706 | 12/1966 | Grimmer et al. | 166/224 A |
| 3,332,497 | 7/1967 | Page, Jr. | 166/224 A |
| 3,411,576 | 11/1968 | Taylor, Jr. | 166/321 |
| 3,448,803 | 6/1969 | Sizer | 166/224 A |
| 3,494,417 | 2/1970 | Fredd | 166/224 A |
| 3,509,913 | 5/1970 | Lewis | 166/224 A |
| 3,543,793 | 12/1970 | Dollison | 166/224 A |
| 3,584,645 | 6/1971 | Radig | 166/224 A |
| 3,642,070 | 2/1972 | Taylor et al. | 166/322 |
| 3,696,868 | 10/1972 | Taylor, Jr. | 166/224 A |
| 3,763,932 | 10/1973 | Dinning | 166/224 A |
| 3,786,865 | 1/1974 | Tausch et al. | 166/224 A |

*Primary Examiner*—James A. Leppink

*Attorney, Agent, or Firm*—Pravel, Wilson & Gambrell

[57] ABSTRACT

A new and improved subsurface safety valve which is inserted into well tubing without requiring removal of the tubing, and which replaces worn, deteriorated and fully or partially inoperative safety valves in the well tubing to prevent blow-outs in wells. The replacement subsurface safety valve may be subsequently removed after insertion without requiring removal of the well tubing.

22 Claims, 10 Drawing Figures

RETRIEVABLE SAFETY VALVE

This is a continuation of application Ser. No. 542,603 filed Jan. 20, 1975, now abandoned, which was a continuation of application Ser. No. 363,532 filed May 24, 1973 now abandoned which was a division of application Ser. No. 131,661, filed Apr. 6, 1971, now U.S. Pat. No. 3,763,933, issued Oct. 9, 1973.

CROSS REFERENCE TO RELATED APPLICATIONS

The present invention is related to my pending application, Serial Number 72,034 filed Sept. 14, 1970, now abandoned, after filing presently pending continuation thereof, application Ser. No. 256,194 filed May 23, 1972 for subsurface safety valves and specific reference to these earlier applications is made.

BACKGROUND OF THE INVENTION

1. Field of the Invention

The present invention relates to subsurface safety valves for well tubing.

2. Description of the Prior Art

In the prior art, safety valves have been mounted with well tubing to control subsurface well pressure and prevent blowouts which caused pollution of the environment, particularly on offshore wells, as well as damage to expensive equipment by explosion, fire and the like. Sand and other abrasive materials in the oil passing through the tubing caused wear and deterioration of the valves rendering them defective and ineffective, and necessitating replacement of the defective valves.

Certain of the prior art safety valves were mounted in well tubing, requiring the well to be shut-in and the tubing removed to replace the defective valve. Removal of the well tubing was expensive and time-consuming and caused reduced production capacity due to the well being shut-in. Further, there was always a risk that the shut-in well might "sand up" or become blocked, requiring reworking of the well before production could be resumed.

Other prior art safety valves such as those known by the name "STORM CHOKES", and those of U.S. Pat. Nos. 3,236,255; 3,411,584; 3,398,762; 3,279,545; and, 3,310,114 were removably mounted with the well tubing and placed in the tubing by wireline and fishing tool or other equipment. Certain of these removable prior art safety valves closed when a pressure surge in the well tubing caused a predetermined pressure drop across a bean or other structure in the tubing, while others closed in response to the pressure surge overcoming a counter-pressure from a predetermined quantity of liquid or gas housed in a portion of the valve housing. Other prior art replacement safety valves had hydraulic operators mounted therewith to control the operation thereof. The hydraulic operator occupied needed space in the well bore and reduced the size of the throughbore which was formed in the replacement valve, restricting the flow of fluid through the well tubing.

With these types of prior art valves, it was difficult to determine whether the valve was defective without removing the valve from the well tubing and inspecting it. Removal and inspection of the valves was expensive and time-consuming, and a risk of blowout was present while the valve was removed for inspection. Also, the prior art safety valves were often ineffective when the wells were producing at or near capacity, being unable to experience any pressure surge due to the high flow rate in the tubing.

SUMMARY OF THE INVENTION

Briefly, the present invention provides a new and improved safety valve for well tubing which is inserted into the well tubing to replace a defective safety valve and form an apparatus for preventing blow-outs.

The replacement safety valve is mounted in the well tubing adjacent the defective valve and is operated to open and close in response to the controls of the defective valve permitting production in the well to continue without requiring that the well tubing string be removed. Once mounted in the tubing string, the replacement safety valve may be tested and operated in place in the well tubing, and retrieved and replaced by a new replacement valve should it become defective.

It is an object of the present invention to provide a new and improved subsurface safety valve.

It is an object of the present invention to provide a new and improved method of replacing safety valves in well tubing.

It is an object of the present invention to provide a new and improved apparatus for preventing well blowouts.

DESCRIPTION OF THE PREFERRED EMBODIMENT

Figure 1A:
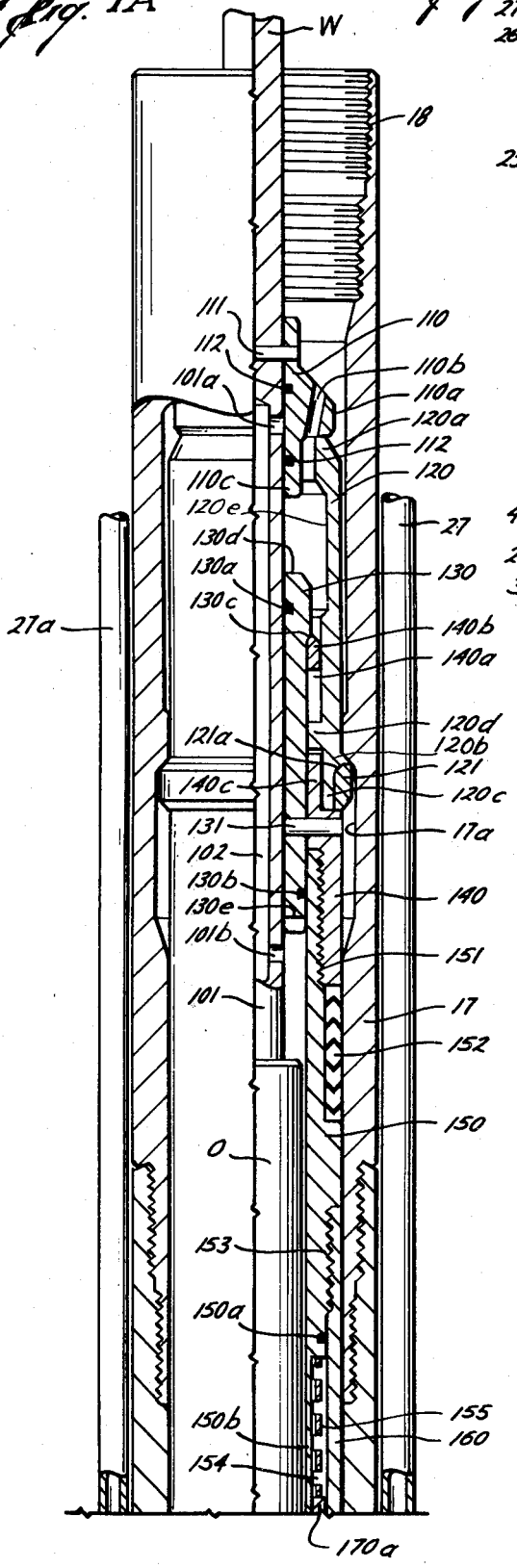
FIGS. 1A, 1B and 1C are elevations, partly in section, of the top, center and bottom portions, respectively, of the subsurface safety valve of the present invention.

The present invention includes a replacement safety valve R which is inserted into a well tubing to replace a safety valve C when it becomes defective due to wear or other reasons. The replacement safety valve R is seated in the well tubing adjacent the defective controlled safety valve C and responds to the conrols of the defective safety valve C and is controlled thereby, as will be more evident hereinbelow, to close the well tubing in order to prevent blow-outs of the well with consequent atmospheric pollution from the escaping oil, and attendant hazards of fire. It should be understood that the replacement safety valve R according to the present invention can be inserted into well tubing to replace other types of defective controlled safety valves and respond to the controls of such defective valves to replace such defective valves.

The safety valve C has a housing H which includes two sections 12 and 13 coupled together at threads 16, and provided with an O-ring seal 16*a*. The upper housing section 12 terminates in an adapter 17 having a threaded box 18 for attachment in a tubing string there-above. At the lower end of lower housing section 13, female threads 19 are provided for threaded engagement with male threads 20 on an adapter 21 having external threads at its lower extremity for attachment to a section of the tubing string therebelow. One or more set screws (not shown) are preferably provided to prevent an inadvertent release of the threaded connection 19, 20.

The wall of the top housing section 12 of the controlled safety valve C (FIG. 1B) has a pair of longitudinally formed passages 25 and 25*a*, each terminating in a threaded fitting 26 and 26*a* for attachment of a hose or pipe 27 and 27*a* respectively, leading to the ground level or surface. The passages 25 and 25*a* and the hoses 27 and 27*a* convey control fluid to the valve C to control such valve, and further to control the retrievable replacement valve R when the valve R is inserted, as will be explained.

The passage 25 connects through a port 28 with a chamber 29 between the section 12 and an upper valve actuator sleeve 30 slidably received in the housing H. Packings 31 and a packing nut or packing keeper 32 are provided in chamber 29. An annular ring or mounting collar 33 (FIG. 1B) is mounted with a groove 30*a* formed in the exterior surface of the sleeve 30 and engages the packing nut 32 at a reduced nose of the packing nut. The annular ring firmly engages the nose on the packing nut 32 to maintain the packing nut 32 in position, sealing the upper end of the chamber 29 when the chamber 29 receives fluid under pressure, as will be more evident hereinbelow. A packing nut 35 (FIG. 1B) seals the lower end of the chamber 29 and holds in place a packing 35*a* (FIG. 1C).

Figure 1B:
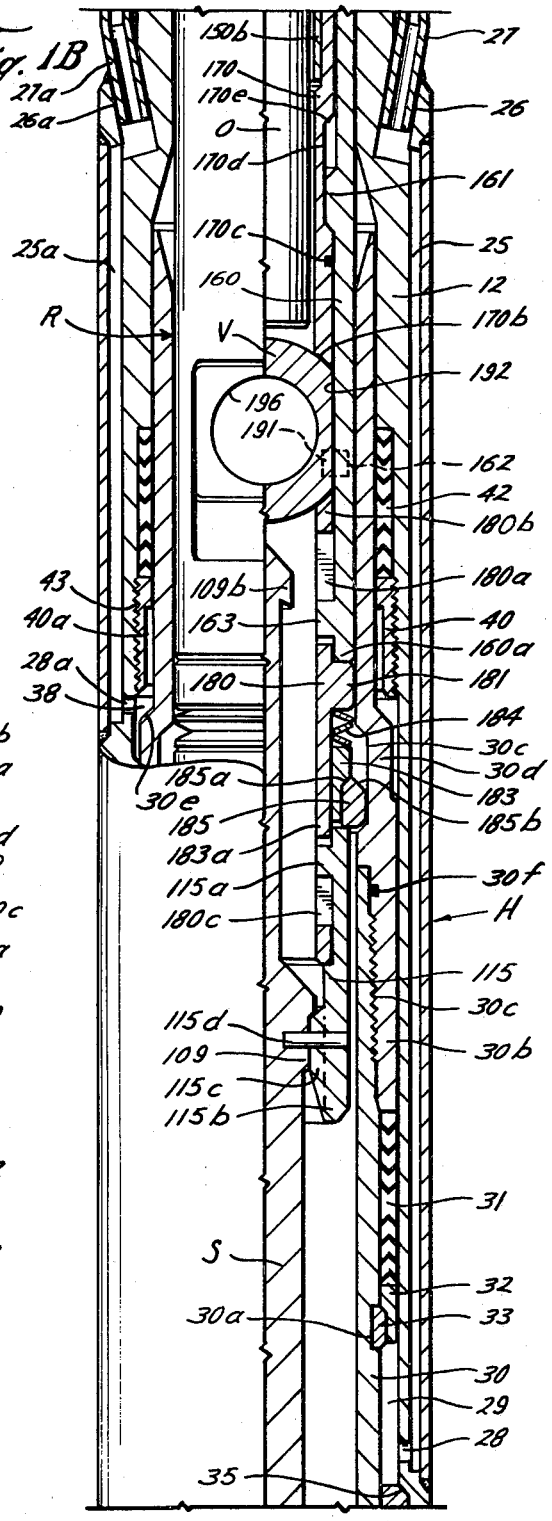

A second chamber 38 is formed between an upper section 30*b* of the sleeve 30 and the housing section 12 and communicates with the control passage 25*a* through a port 28*a* (FIG. 1B). The upper section 30*b* of the sleeve 30 is mounted with the sleeve 30 along a threaded surface 30*c* to move with the sleeve 30. A sealing O-ring 30*f* is provided between the upper section 30*b* and the sleeve 30.

An internal shoulder 40*a* of a locking nut 40 and a tapered surface 30*e* of the upper section 30*d* of the sleeve 30 forms walls of the chamber 38. The locking nut 40 mounts a packing 42 to a threaded surface 43 of the housing section 12. One or more securing set screws (not shown) may be provided for the lock nut 41 to prevent movement of the nut 41 and the packing 42 with respect to the housing section 12.

Figure 1C:
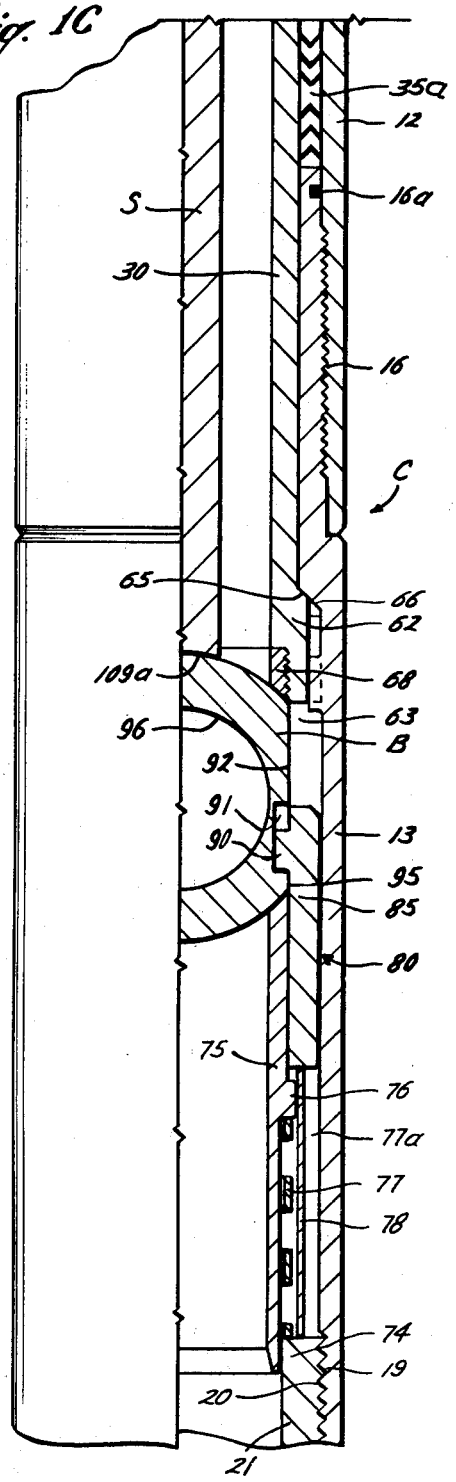

The valve actuating sleeve 30 has a collar 62 disposed in an annular chamber 63 between the housing section 13 and a rotatable ball-type valve B of the controlled safety valve C (FIG. 1C). The collar 62 has an inclined surface 65 for engagement with an inclined sealing shoulder 67 on the housing section 13. An annular seat ring 68 formed of rubber, metal, plastic or other suitable material is internally threaded in the collar 62 for sealingly engaging the upstream face of the ball valve B.

Slidably received in an upper portion 74 of the adapter sub 21 is a lower valve acutator sleeve 75 which, at its upper end, bears against the ball valve B. The lower sleeve 75 has an intermediate external collar 76 extending into a chamber 77*a* for engagement by a heavy coiled compression spring 77 which also engages the adapter 21.

Figure 5:
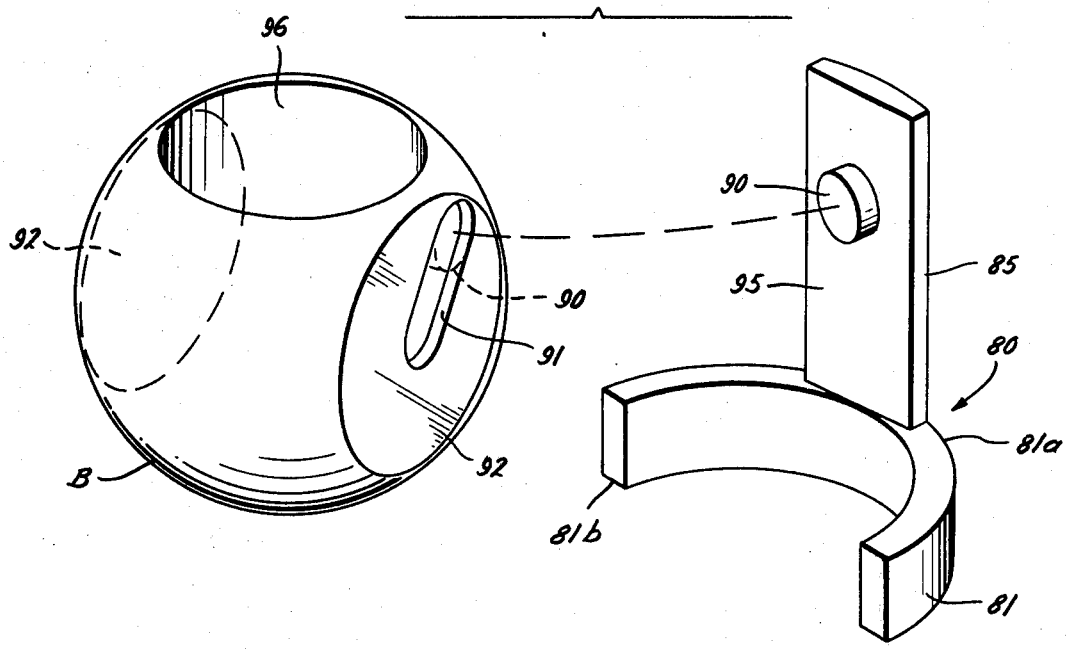
FIG. 5 is an exploded isometric view of the rotatable ball-type valve and valve pivot means of the subsurface safety valve of the present invention.

A valve pivot means 80 has a lower collar 81 and an upwardly extending tongue portion 85 (FIG. 5). An outer surface 81*a* of the collar 81 bears against the housing H (FIG. 1B). Two of the pivot means 80 are mounted within the housing section 13 on diametrically opposed sides thereof contacting each other at flat end surfaces 81*b* of the collars 81. A sleeve 78 mounted in the chamber 77 above the adapter sub 21 maintains each of the pivot means in proper position in the housing section 13. The pivot means 80 may be integrally formed with or otherwise suitably mounted with the housing 13 if desired. A set screw may be used to lock and retain the pivot means 80 in position in the housing section 13, if desired. The tongues 85 include inwardly projecting pivot pins 90 (FIGS. 1B and 5) which are received in slots or recesses 91 in a flat side surface 92 formed on diametrically opposed faces of the ball valve B. An end wall 91*a* on the face of the ball valve B retains the pin 90 in the slot 91 and prevents the pin 90 from becoming unseated during movement of the ball valve B. The pivot pins 90 of the valve pivot means 80 slide within the grooves 91 in the surfaces 92 of the valve B and permit rotational movement, as will be set forth below, of the valve B with respect to the housing H from a closed position (FIG. 8) blocking the well tubing to a partially open position (FIG. 7) to an open position (FIG. 6), permitting passage of well fluid through the well tubing. The tongues 85 have complementary flat surfaces 95 abutting the valve surfaces 92 upon which the valve surfaces 92 rotate.

The valve B is generally ball shaped with a cylindrical through passage 96 which, in diameter, substantially equals the internal diameter of the valve actuator sections 30 and 75 and also the adapters 17 and 21, which in turn, have substantially the same internal diamter as that of the conventional tubing string connected thereto. In other words, the valve B has a full opening when in the open position (FIGS. 2 and 6) for the passage of well tools and for performing well operations therethrough.

The parts of the controlled safety valve C may also be made and assembled in the sequence set forth in my co-pending patent application, if desired.

The retrievable replacement safety valve R of the present invention is moved into well tubing (not shown) by a wireline W or other suitable means. An upper attaching member 110 (FIG. 1A) is mounted with the wireline W by a releasable shear pin 111 and has a plurality of sealing O-rings 112 therewith. An annular shoulder 110*a* of the attaching member 110 which engages an upper housing section 120 at an upper end 120*a* thereof has one or more ports 110*a* formed about the periphery thereof. The ports 110*a* permit the well fluid to pass through the shoulder 110*b* of the attaching member 110 and permit upward movement of the attaching member 110 with respect to the retrievable safety valve R after such valve has been seated in the well tubing adjacent the defective safety valve C to replace such valve C, as will be more evident hereinbelow.

A lower portion 101 of the wireline W has a first inlet port 101*a* and a second inlet port 101*b* communicating with the exterior of the wireline W and a hollow interior portion 102 of the wireline W to permit passage of the well fluid through the wireline W at the lower end thereof in order to facilitate removal of the wireline W from the tubing after the retrievable safety valve R has been mounted in the well tubing. An overshot tool O or other suitable means for engaging a well tool to permit removal of such tool from a well tubing by a wireline is mounted with the lower end 101 of the wireline W. The overshsot tool O is mounted within the retrievable safety valve R when such valve is being moved in the well tubing to be seated adjacent the valve to be replaced, but is removed from the well tubing to permit continuation of operations of the well after the defective valve has been replaced by the retrievable safety valve R.

The upper housing section 120 of the retrievable valve R engages the attaching member 110 at the upper end 120*a* thereof, and has an annular resilient metal split ring 121 mounted below a lower end 120*b* as the safety valve R is being lowered through the well tubing. An annular socket 120*e* is formed in the member 120 to receive a fishing tool when the valve R is removed from the well tubing. The lower end 120*b* has a reduced nose 120*c* for engaging an outwardly tapered surface 121*a* of the annular split ring 121 and forcing the ring 121 outwardly into an annular sleeve 17*a* formed in the interior wall of the adapter sub 17. The longitudinal dimension of the annular sleeve 17*a* is somewhat longer than that of the resilient split ring 121 in order to permit longitudinal movement of the housing section 120 and the retrievable safety valve R with respect to the adapter sub 17 and housing section 12 and 13 of the safety valve C to be replaced, for reasons to be more evident hereinbelow. The annular sleeve 17*a* is formed at a position in the adapter sub 17 chosen such that the retrievable safety valve R will be positioned adjacent the defective controlled safety valve C when the retrievable valve R is to be seated.

A plurality of radially inwardly extending fingers 120*d* are formed on the inner surface of the upper housing section 120. The fingers 120*d* are mounted within a corresponding plurality of radial slots 140*a* formed between an upper portion 104*b* and a center portion 140*c* of the housing section 140. The longitudinal dimension of the slots 140*a* is larger than the longitudinal thickness of the fingers 120*d* to permit the lower end 120*c* of the upper housing section 120 to move downwardly and force the split ring 121 outwardly into the annular sleeve 17*a* to seat the retrievable valve R in the adapter sub 17.

A second attaching member 130 is mounted with the center portion 140*c* of the intermediate housing section 140 by a releasable shear pin 131. The attaching member 130 has a plurality of sealing O-rings 130*a* and 130*b* mounted therewith and further has an outwardly tapered shoulder portion 130*c* at an upper end thereof to limit upward movement of the upper portion 140*b* of the housing section 140. An upper surface 130*d* of the attaching member 130 engages a lower portion 110*c* of the attaching member 110, and a lower surface 130*e* of the attaching member 130 engages the overshot tool O when the releasable shear pins 111 and 131 have fractured, and the wireline W is removing the overshot tool O and the attaching members 130 and 110 from the well tubing to permit production in the well to continue.

A spring housing section 150 of the retrievable valve R is mounted with the intermediate housing section 140 along a threaded surface 151 to hold a packing 152 firmly in place with the interior of the adapter sub 17 to seal the exterior of the retrievable safety valve R with the interior of the valve C to be replaced. The spring housing section 150 is mounted with a lower housing section 160 of the retrievable valve R along a threaded surface 153, and a sealing O-ring 150*a* is mounted therebetween for sealing purposes. A downwardly extending collar 150*b* of the spring housing section 150 and the lower housing section 160 form a chamber 154 in which a coiled compession spring 155 is mounted. The compression spring 155 exerts a downward force on an upper portion 170*a* of a first control sleeve 170 and responds to a downward movement of the control sleeve 170 to urge a rotatable replacement ball-type valve V from a closed position to an open position in the well tubing.

A lower engaging shoulder 170*b* of the sleeve 170 engages the valve V to rotate such valve open as the sleeve 170 moves downwardly in response to the compressive force in the spring 155. A sealing O-ring 170*c* is mounted with the exterior of the sleeve 170 to provide a seal between the sleeve 170 and the housing section 160.

Figure 2:
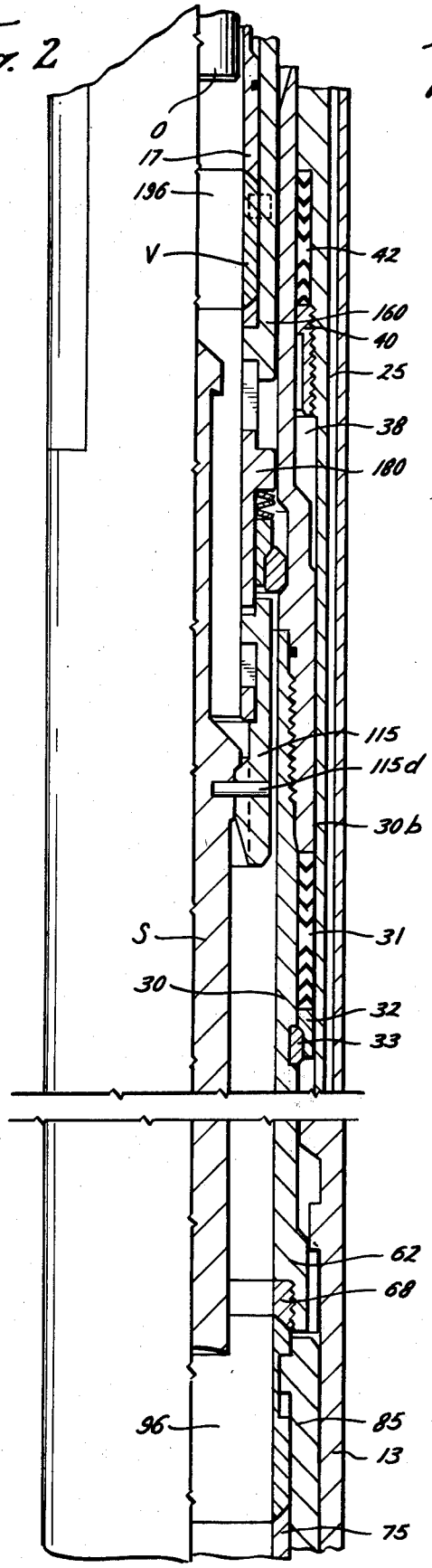
FIG. 2 is an elevation, partly in section, of the valve of FIGS. 1A, 1B and 1C with parts thereof in a different position.
Figure 6:
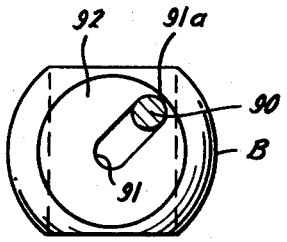
FIGS. 6, 7 and 8 are elevations showing the ball-type valve of FIG. 5 in different operating positions.
Figure 7:
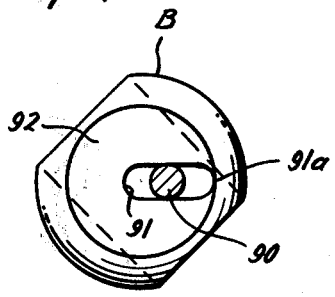
Figure 8:
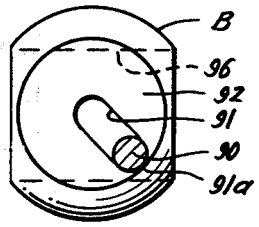

A shoulder 161 of the housing section 160 is mounted in an annular groove 170*d* formed in the sleeve 170 to limit downward movement of the control sleeve 170 by engaging a tapered surface 170*e* of the sleeve 170. A pair of sockets 162 are formed in the inner wall of the housing section 160 and receive a corresponding pair of pins 191 extending outwardly from a surface 192 of the replacement valve V. The replacement valve V rotates in response to downward movement of the sleeve 170 from a closed to a partially open to an open position in a like manner to the ball valve B (FIGS. 5 and 8), as previously set forth, in order that a cylindrical through passage 196 may be aligned with the interior of the well tubing to permit well fluids to continue passage through the well tubing. The ball valve V rotatably moves as shown in FIGS. 8, 7 and 6, in response to the downward movement of the sleeve 170 to align the passage 196 with the interior of the well tubing T. A plurality of radially inwardly extending fingers 163 are formed on the inner surface of the lower housing section 160 and are mounted within a corresponding plurality of longitudinal slots 180*a* formed in a first control sleeve 180 to permit downward movement of the control sleeve 180 with respect to the housing section 160 during rotational movement of the replacement valve V to an open position (FIG. 2).

A lower surface 160*a* of the lower housing section 160 engages an annular shoulder 181 of the control sleeve 180 to limit upward movement of the control sleeve 180 with respect to the housing section 160. An upper engaging shoulder 180*b* of the sleeve 180 engages the inwardly extending fingers 163 to limit downward movement of the sleeve 180 with respect to the housing 160. The upper portion 180*b* engages the replacement valve V and moves downwardly in response to rotational movement of the valve V. A spring 184 is mounted between a movable collar 183 and shoulder 181 of the sleeve 180. The collar 183 has a reduced nose portion 183*a* formed at a lower end thereof. An annular resilient split ring 185 is mounted externally of and below the nose portion 183*a* as the retrievable valve R is lowered in the well tubing. The split ring 185 is driven outwardly into an annular groove 30*e* by the downward movement of the collar 183 urged by the spring 184 when the ring 185 is aligned with the groove 30*e* to thereby seat the retrievable valve R with respect to the defective valve C. The annular groove 30*e* is formed in a position in the housing section 30 such that the retrievable valve R is seated in the well tubing adjacent the defective valve C so that the retrievable valve R may be operated and controlled by the controls of the defective valve C, as will be more evident hereinbelow.

An outwardly tapered camming surface 185*a* and an inwardly tapered camming surface 185*b* are formed at the upper end of the split ring 185. The camming surface 185*a* engages the movable collar 183 and transmits the force from the spring 184 to cause outward expansion of the ring 185 into the annular groove 30*e*. The camming surface 185*b* engages the inner wall of the housing section 30 of the valve C and causes contraction of the ring 185 during upward movement and subsequent removal of the retrievable valve R and when the retrievable valve R becomes defective due to wear and the like.

A plurality of slots 180*c* are formed in the sleeve 180 at the lower end thereof and receive a corresponding plurality of inwardly radially extending fingers 115*a* of a third attachment member 115. The longitudinal dimensions of the slot 180*c* are greater than the longitudinal thickness of the fingers 115*a* to permit relative movement between the attaching member 115 and the sleeve 180 during seating of the retrievable valve R in the well tubing adjacent the defective valve C. A plurality of inwardly extending ridges 115*c* are formed at a lower portion 115*d* of the attaching member 115 to engage an annular shoulder 109*a* of a spacing rod S. A releasable shear pin 115*d* mounts the attaching member 115 with the spacing rod S. The spacing rod S engages the rotatable ball-type valve B of the defective valve C at a lower end 190*a*. The length of the spacing rod S is chosen to insure that the split ring 185 is adjacent the annular groove 30*e* in the housing section 30 of the valve C when the retrievable valve R is mounted with the defective valve C.

An annular collar or lip 109*b* is formed at the upper end of the spacing rod S in order that the overshot tool O may grasp the spacing rod S and remove such from the well tubing when the retrievable valve R has been installed to replace the defective valve C.

In the use or operation of the apparatus of the invention, it is used in connection with the safety valve C of this invention which has been previously mounted in a production tubing string in a well where it is desired to provide for automatic closing of the well in the event the well pressure should become excessive, indicating possible imminence of a blowout. Therefore, the operation of the safety valve C is first considered hereinafter. Normally, the spring 77 urges the lower acutator sleeve 75 upwardly to maintain the valve passage 96 transversely of the flow passage within the sleeves 30 and 75 thereby positioning the valve B in the closed position (FIGS. 1C and 8). The full force of the well pressure then is exerted against the lower face of the ball valve B urging it into sealing contact with the ring 68, the upward movement of which is limited by the engagement of the shoulder 65 with the shoulder 66, so that the flow passage is effectively sealed off. In order to open the valve, control fluid under pressure is supplied selectively from the surface through the pipe 27*a*, passage 25*a* and port 28*a* and applied to the annular wall 30*a* on the upper actuator sleeve 30. The fluid pressure moves the upper actuator sleeve 30 downwardly and causes rotation of the ball valve B about the pivot pins 90 from the closed position (FIGS. 1C and 8) to a partially open position and finally to an open position (FIGS. 2 and 6) with the valve passage 96 aligned with the flow passages through the valve actuator sleeves 30 and 75.

In the fully open position of the ball valve B, the spring 77 is substantially fully or partially compressed. Thus, in normal operation of the safety valve C, the ball valve B is held in the open position by control fluid which is at least sufficient to overcome the returning force of the spring 77.

In order to close the safety valve C, the fluid pressure through the pipe 27*a*, the passage 25*a* and the port 28*a* may be relieved, permitting the compressive force in the spring 77 to move the actuator sleeve 75 and 30 upwardly to rotate the ball valve B from the open position (FIG. 6) to the closed position (FIG. 8). Alternatively, control fluid under pressure may be selectively supplied from the surface through the pipe 27, the passage 25 and the port 28 and applied to the packing keeper 32 and packing keeper mounting collar 33 by the fluid in the chamber 29, moving the upper actuator sleeve 30 upwardly and causing rotation of the ball valve B about the pivot pins 90 from the open position (FIGS. 2 and 6) to a partially closed position (FIG. 7) and finally to a closed position (FIGS. 1C and 8) with the valve passage 96 transverse of the flow passage within the sleeves 30 and 75 and the well tubing.

In the event the safety valve C becomes worn or deteriorated as a result of the abrasive ingredients in the well fluid after a period of extended use or if for any other reason it becomes desirable to replace the valve C, the retrievable safety valve R of the present invention may be inserted into the well tubing and moved into place adjacent the defective safety valve C and operated by the controls of the defective safety valve C to provide for automatic closing of the well in the event the well pressure should become excessive, indicating a possible blowout. Fluid is applied under pressure from the surface through the pipe 27, passage 25 and port 28 into the chamber 29, causing upward movement of the actuator sleeve 30 and 75, as has been set forth. The application of the fluid pressure in the chamber 29 rotates the ball valve B of the defective safety valve C to a closed position in order to provide a surface for engagement with the lower end 109*a* of the spacing rod S, in order to assure proper seating of the replacement retrievable valve R in the well tubing, and further to reduce the likelihood of a blowout while the retrievable safety valve R is being inserted in the well tubing. The retrievable safety valve R is inserted in the well tubing and lowered in the well tubing until the spacing rod S engages the closed ball valve B, insuring proper positioning of the retrievable safety valve R in the well tubing.

Control fluid under pressure is inserted in the well tubing T forcing the retrievable safety valve R downwardly, forcing the annular ring 185 downwardly until aligned with the recess 30*e* so that the spring 184 then pushes the movable collar 183 to force the ring 185 outwardly into engagement with the annular groove 30*e* in the housing section 30 of the defective valve C, seating the retrievable safety valve R in the well tubing adjacent the defective safety valve C.

Increased pressure is then introduced into the well tubing, causing further downward movement of the attaching member 110 and the upper housing section 120, whereby the lower end 120*b* of the housing section 120 forces the split ring 121 into the groove 17*a* in the adapter sub 17, seating the retrievable safety valve R at an upper end thereof in the well tubing adjacent the defective safety valve C.

The wireline W is pulled slightly upwardly, causing relative movement between the attaching members and the retrievable safety valve R, shearing the releasable shear pin 131 mounted between the wireline W and the valve R.

Control fluid under pressure is then supplied selectively from the surface through the pipe 27a, the passage 25a and the port 28a and applied to the chamber 38, causing downward movement of the actuator sleeves 30 and 75 of the defective safety valve C, overcoming the compression in the spring 77, and rotating the ball valve B of the defective valve C to an open position. The fluid pressure in the chamber 38 forcing the actuator sleeve 30 downwardly further moves the first control sleeve 180 of the retrievable safety valve R downwardly, moving the engaging shoulder 180b out of contact with the rotatable replacement valve V, and allowing the compressive force in the spring 155 to force the second control sleeve 170 of the retrievable valve R downwardly, rotating the rotatable valve B to an open position through the engagement at an engaging shoulder 170b. The valve passage 196 of the replacement valve V is then aligned with the flow passages through the well tubing, the actuator sleeves 30 and 75 of the valve C, the control sleeves and housing sections of the retrievable valve R.

Figure 3:
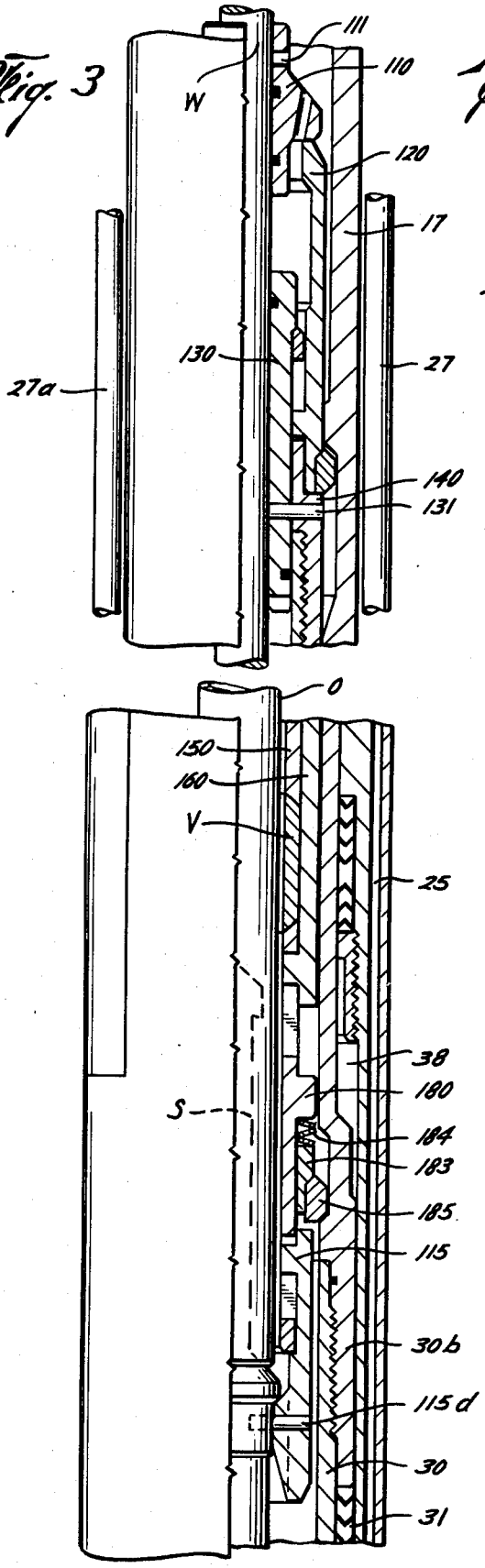
FIG. 3 is an elevation, partly inssection, of the valve of FIGS. 1A, 1B and 1C with parts thereof in a different position.

The wireline W is subsequently lowered further in the well tubing, and the attaching member 110 engages the upper housing section 120 and resists further movement, shearing the releasable sheer pin 111 and allowing the overshot tool O to be lowered to a position where contact may be made with the outer collar 109a at the upper end of the spacer rod S in order that the spacer rod S may be grasped by the overshot tool O (FIG. 3). Subsequently, the wireline W is moved upwardly, with the overshot tool O grasping the spacer rod S and pulling the spacer rod S upwardly, while shearing the releasable shear pin 115d between the spacer rod S and the attaching member 115. Upon further upward movement of the overshot tool O, its shoulder 99 (FIG. 1A) engages the attaching member 130 at the lower surface 130e thereof and lifts such member 130 upwardly, shearing the pins 131. Subsequently, the surface 130d engages the lower end 110c of the attaching member 110 and lifts same upwardly, in order that the well tubing may be cleared and production by the well may continue (FIG. 4).

In the event it is desired to close the retrievable valve R mounted in the well tubing to replace the valve C, control fluid under pressure is supplied to the controls of the control valve C, expanding the chamber 29, and causing upward movement of the actuator sleeve 30 of the valve C. Upward movement of the actuator sleeve 30 of the valve C causes upward movement of the ring 185 and the first control sleeve 180 of the retrievable valve R. The engaging shoulder 180b of the valve of the control sleeve 180 contacts the replacement valve V, rotating the valve V to a position wherein the passage 196 is transverse the well tubing, and overcoming the compressive force of the spring 155 exerted downwardly on the second control sleeve 170. The replacement valve V thereby blocks the well tubing and prevents a blowout in response to the controls of the defective valve C.

Figure 4:
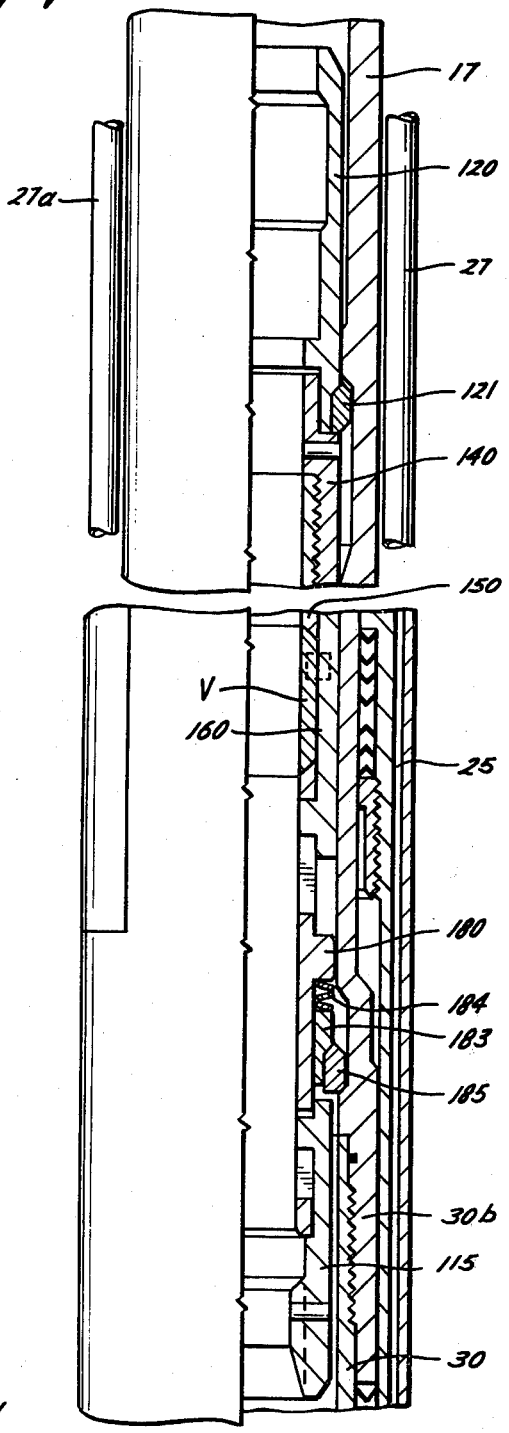
FIG. 4 is an elevation, partly in section, of the valve of FIGS. 1A, 1B and 1C with parts thereof in a different position.

In the event it is subsequently desired to open the retrievable safety valve R and the replacement valve V thereof, control fluid under pressure is supplied selectively from the surface to the pipe 27, passage 25a and port 28 and applied in the chamber 38 to the upper actuator sleeve 30, moving the upper actuator sleeve 30 downwardly and consequently causing downward movement of the control sleeve 180 of the retrievable valve R, permitting the spring 155 to urge the second control sleeve 170 of the valve R downwardly to rotate the valve V to the open position (FIG. 4).

In the event that the retrievable safety valve R becomes worn or deteriorated after further subsequent use, a conventional fishing tool is inserted by wireline into the well tubing until outwardly extending fingers of such fishing tool engage the socket 120e in the upper housing section 120 of the retrievable valve R. The wireline W and fishing tool and retrievable safety valve R are extracted from the well tubing by the wireline W, and the retrievable safety valve R is removed from the well tubing. Subsequently, a new retrievable safety valve R to replace the worn retrievable safety valve R is inserted and seated in the well tubing adjacent the safety valve C in the same manner as heretofore described.

It should be understood that in place of the wireline W, the retrievable valve R could be provided with a conventional fishing neck and dropped into the well tubing so that the spacing rod S engages the closed ball valve B. The retrievable valve V would be seated and controlled in the manner heretofore discribed, and would be retrieved by a conventional fishing tool when it became desirable to replace the retrievable valve, as has been previously set forth.

The foregoing disclosure and description of the invention are illustrative and explanatory thereof, and various changes in the size, shape, and materials as well as in the details of the illustrated construction may be made without departing from the spirit of the invention.

I claim:

1. A method of operably replacing a first controlled subsurface safety valve connected in and forming a portion of a well tubing, comprising the steps of:

mounting the first controlled subsurface safety valve in the well tubing at a subsurface location in a well;

operating the first controlled subsurface safety valve in response to increased control fluid pressure communicated to the valve by a passageway separate from the well tubing for enabling flow through the well tubing;

moving a second subsurface safety valve into the well tubing when the first controlled subsurface safety valve malfunctions;

positioning the second safety valve within the first controlled subsurface safety valve; and operating the second safety valve in response to the operation of the first safety valve by the increased control fluid pressure communicated to the first controlled safety valve.

2. The method of claim 1, further including the step of:

retrieving the second valve from adjacent the first valve.

3. The method of claim 1, wherein said step of controlling comprises the step of:

closing the second valve to block passage of well fluids through the well tubing to prevent blowouts and the like.

4. The method of claim 1, wherein the step of controlling comprises the step of:

opening the second valve to permit passage of well fluids through the well tubing.

5. The method of claim 4, wherein the step of opening includes:

rotating a closure element to permit passage of well fluids through the well tubing.

6. The method of claim 5, wherein said step of opening further includes:

moving the closure element vertically while rotating to open.

7. The method of claim 5, wherein said step of controlling further comprises the step of:

closing the second valve by rotating a closure element to block passage of well fluids through the well tubing.

8. The method of claim 1, including the step of:

seating the second valve in the well tubing adjacent the first valve.

9. The method of claim 8, wherein the step of seating includes the step of:

mounting the second valve adjacent the first valve for controlling operation of the second valve with the controls of the first valve.

10. The method as set forth in claim 8, wherein said step of mounting includes the step of:

engaging a groove with the second valve for mounting the second valve adjacent the first valve.

11. A method of operably replacing a malfunctioning first surface controlled subsurface safety valve connected in a well tubing, comprising the steps of:

moving a second subsurface safety valve into the well tubing;

positioning the second subsurface safety valve adjacent the first subsurface safety valve;

operating the second valve to control flow through the well tubing and first safety valve in response to the controlled operation of the first safety valve by increased control fluid pressure from the surface;

sealing the second valve with the first valve for blocking passage of fluid therebetween;

retrieving the second valve from adjacent the first valve; and installing another second subsurface safety valve adjacent the first subsurface safety valve to replace the second subsurface safety valve previously removed.

12. A method of operably replacing a malfunctioning first surface controlled subsurface safety valve connected in a well tubing, comprising the steps of:

moving a second subsurface safety valve into the well tubing;

positioning the second subsurface safety valve adjacent the malfunctioning first valve;

seating the second subsurface safety valve in the well tubing adjacent the first subsurface safety valve;

sealing the second valve with the first valve for blocking passage of fluid therebetween;

operating the second safety valve in response to the controlled operation of the first safety valve by an increased control fluid pressure communicated to the first safety valve independently of the well tubing pressure for enabling flow through the well tubing; and retrieving the second safety valve by moving from adjacent the first safety valve through the well tubing when desired.

13. The method as set forth in claim 12, wherein said step of retrieving includes the step of:

moving the second valve from adjacent the first valve through the well tubing.

14. The method as set forth in claim 12, including the step of:

installing another second valve adjacent the first valve to replace the second valve previously removed.

15. A method of operating a controlled retrievable second valve in a well tubing having a first controlled valve connected in the well tubing, said first controlled valve having a valve actuating member mounted therewith for controlled movement by the controls of the first control valve, comprising the steps of:

moving the retrievable second valve through the well tubing to a location adjacent the first valve; and controlling the operation of the second valve with the controls of the first controlled valve in response to the controlled movement of the valve actuating member by the controls of the first controlled valve.

16. The method of claim 15, further including the step of:

positioning the second valve adjacent the first valve prior to said step of operating the second valve with the controls of the first valve.

17. The method of claim 15, including the step of:

mounting the second valve adjacent the first valve prior to said step of operating the second valve with the controls of the first valve.

18. The method of claim 15, further including the step of:

retrieving the second valve by moving the second valve through the well tubing from adjacent the first valve when desired.

19. The method as set forth in claim 15, including the step of:

controlling the operation of the first controlled valve with control fluid pressure communicated to the first controlled valve.

20. The method as set forth in claim 19, including the step of:

increasing the control fluid pressure communicated to the first controlled valve for opening the second retrievable valve to enable flow of fluids through the well tubing.

21. The method as set forth in claim 20, including the step of:

reducing the control fluid pressure communicated to the opened first controlled valve for closing the second retrievable valve to block flow of fluids through the well tubing.

22. The method as set forth in claim 21, including the step of:

communicating a second control fluid pressure to the first controlled valve flow closing the second retrievable valve to block flow of fluids through the well tubing.

* * * * *